US010246313B2

(12) United States Patent
Kendall et al.

(10) Patent No.: US 10,246,313 B2
(45) Date of Patent: Apr. 2, 2019

(54) PRECAST CONCRETE PIT

(71) Applicant: Vehicle Service Group, LLC, Madison, IN (US)

(72) Inventors: Larry Kendall, Madison, IN (US); Gerry Lauderbaugh, Madison, IN (US); Chuck Luhn, Madison, IN (US); Gregory Buccola, Louisville, KY (US); Jonathan J. Westbrook, Buckner, KY (US); Jonathan Ross, Beaver Dam, KY (US)

(73) Assignees: Vehicle Service Group, LLC, Madison, IN (US); Gregory Buccola, Louisville, KY (US)

( * ) Notice: Subject to any disclaimer, the term of this patent is extended or adjusted under 35 U.S.C. 154(b) by 43 days.

(21) Appl. No.: 15/225,027

(22) Filed: Aug. 1, 2016

(65) Prior Publication Data

US 2017/0029255 A1 Feb. 2, 2017

Related U.S. Application Data

(60) Provisional application No. 62/199,740, filed on Jul. 31, 2015.

(51) Int. Cl.
*B66F 7/28* (2006.01)
*B66F 7/16* (2006.01)
(Continued)

(52) U.S. Cl.
CPC ..... *B66F 7/28* (2013.01); *E04B 2/18* (2013.01); *E04B 2/20* (2013.01); *E04B 2/26* (2013.01); *E04H 6/428* (2013.01)

(58) Field of Classification Search
CPC .... B66F 7/28; B66F 7/00; B66F 13/00; E04B 1/043
See application file for complete search history.

(56) References Cited

U.S. PATENT DOCUMENTS 1,638,790 A 8/1927 Weaver
1,758,262 A 5/1930 Mahoney
(Continued)

FOREIGN PATENT DOCUMENTS

BE 366902 A 11/1930
CH 131433 A 2/1929
(Continued)

OTHER PUBLICATIONS

Celette La Vega brochure (1996), 2 pgs.
(Continued)

*Primary Examiner* — Diem M Tran
(74) *Attorney, Agent, or Firm* — Frost Brown Todd, LLC

(57) ABSTRACT

A concrete pit for housing the below-floor part of a vehicle lift that is at least partially below floor level is constructed of precast concrete pieces. In one embodiment, a trench is dug slightly bigger than the pit that will be installed, and a precast concrete base slab is placed in the hole. Features around the perimeter of the base slab mate with corresponding features around the bottom of a precast concrete hollow rectangle, which is placed on top of the base slab. Additional precast concrete hollow rectangles may be placed on top. A vehicle lift is placed within the concrete pit and in some embodiments fixed thereto using holes, protrusions, or other features built into the concrete pit. In some embodiments, plumbing, wiring conduit, and other passageways are cast into the pieces of the concrete pit to minimize manual installation work that needs to be done in the pit.

15 Claims, 2 Drawing Sheets

(51) Int. Cl.

| | |
|---|---|
| ***E04H 6/42*** | (2006.01) |
| ***E04B 2/18*** | (2006.01) |
| ***E04B 2/20*** | (2006.01) |
| ***E04B 2/26*** | (2006.01) |

(56) References Cited

U.S. PATENT DOCUMENTS 2,132,343 A 10/1938 Moss
2,557,465 A 6/1951 Rauscher, Sr.
2,891,765 A 6/1959 Pearne
2,942,848 A 6/1960 Friesen
2,984,072 A 5/1961 Born
3,038,700 A 6/1962 Ascherl
3,195,860 A 7/1965 Gausewitz
3,265,357 A 8/1966 Schilling
3,289,868 A 12/1966 Miller
3,340,720 A 9/1967 Chartier
3,377,924 A 4/1968 Spencer et al.
3,429,473 A * 2/1969 Boucher ..... E04H 7/18 220/4.16
3,486,583 A 12/1969 Wiklund
3,556,480 A 1/1971 Johansson
3,638,535 A 2/1972 Ponter
3,689,030 A 9/1972 Backus
3,732,831 A * 5/1973 Marciniak ..... E04B 1/04 109/82
3,757,899 A 9/1973 Smith
3,835,693 A 9/1974 Majersky
3,837,435 A * 9/1974 Pelouch ..... B66F 7/0625 187/211
3,967,701 A 7/1976 Hegenbart
3,968,730 A 7/1976 Lionet
3,991,857 A 11/1976 Wolk et al.
4,151,737 A 5/1979 Specktor
4,230,304 A 10/1980 Tol
4,241,901 A 12/1980 Shircliffe
4,336,705 A 6/1982 Specktor
4,398,410 A 8/1983 McWhorter et al.
4,501,136 A 2/1985 Celette
4,534,544 A 8/1985 Heide
4,574,614 A 3/1986 Field
4,679,489 A 7/1987 Jasinski et al.
4,706,458 A 11/1987 Corghi
4,724,930 A 2/1988 VanLierop
4,763,761 A 8/1988 McKinsey et al.
4,777,798 A 10/1988 Jacobson et al.
4,823,589 A 4/1989 Maxwell, Jr. et al.
4,848,732 A 7/1989 Rossato
4,901,980 A 2/1990 Hansen
4,961,293 A * 10/1990 House ..... B65D 88/76 52/21
4,986,107 A 1/1991 Peyret
5,012,898 A 5/1991 Tsymberov
5,016,465 A 5/1991 Papesh
5,024,141 A 6/1991 Kawada
5,027,639 A 7/1991 Hinson
5,031,726 A 7/1991 Wakamiya
5,050,844 A 9/1991 Hawk
5,065,844 A 11/1991 Hon
5,096,159 A 3/1992 Fletcher
5,099,956 A 3/1992 Curran
5,131,257 A 7/1992 Mingardi
5,157,228 A 10/1992 Ackermann et al.
5,186,038 A 2/1993 Venalainen
5,189,899 A 3/1993 Hsu
5,190,122 A 3/1993 Fletcher et al.
5,199,289 A 4/1993 Hinson
5,199,686 A 4/1993 Fletcher
5,211,265 A 5/1993 Gregg
5,239,854 A 8/1993 Hinson
5,251,013 A 10/1993 Danielson
5,263,357 A 11/1993 Dumais
D346,255 S 4/1994 Francis et al.
5,299,658 A 4/1994 Cox et al.
5,299,904 A 4/1994 Simon et al.
5,341,575 A 8/1994 Chisum
5,355,711 A 10/1994 Chisum
5,596,900 A 1/1997 Pietrelli
5,640,878 A 6/1997 Hinson
5,644,946 A 7/1997 Weschler
5,679,934 A 10/1997 Juntunen et al.
5,695,173 A 12/1997 Ochoa et al.
5,724,853 A 3/1998 Johansson
5,727,655 A 3/1998 Pitman
5,740,886 A * 4/1998 Fletcher ..... B66B 9/04 187/205
5,778,608 A * 7/1998 Elliott, Jr. ..... B65D 88/76 220/565
5,801,834 A 9/1998 Danielson
5,829,948 A 11/1998 Becklund
5,860,491 A * 1/1999 Fletcher ..... B66B 9/04 187/203
5,918,500 A 7/1999 Brewer, Jr.
5,929,399 A 7/1999 Jamieson et al.
5,931,043 A 8/1999 Liegel et al.
5,967,494 A 10/1999 Fiorese
6,000,272 A 12/1999 Hinson
6,032,421 A * 3/2000 Yamada ..... E02D 27/12 220/4.26
6,050,573 A 4/2000 Kunz
6,059,263 A 5/2000 Otema et al.
6,164,415 A 12/2000 Takeuchi et al.
6,189,432 B1 2/2001 Colarelli et al.
6,213,451 B1 4/2001 Finkbeiner
6,269,676 B1 8/2001 Soyk
6,286,629 B1 9/2001 Saunders
6,443,429 B1 9/2002 Hawk et al.
6,484,554 B2 11/2002 Soyk
6,601,430 B2 8/2003 McClellan
6,679,479 B1 1/2004 Watkins
6,763,916 B2 7/2004 Green et al.
6,918,576 B2 7/2005 Finkbeiner
6,974,123 B2 12/2005 Latvys
6,983,196 B2 1/2006 Green et al.
7,066,448 B2 6/2006 Thurm
7,213,686 B2 5/2007 Kaufman
7,225,898 B2 6/2007 Bourgeois
7,275,713 B2 10/2007 Hillsamer et al.
8,052,122 B2 11/2011 Rossato et al.
8,286,944 B2 10/2012 Rossato et al.
8,496,090 B2 7/2013 Berends
8,752,675 B2 6/2014 Berends
8,770,549 B2 7/2014 Deuring et al.
8,888,070 B2 11/2014 Olesen
9,050,223 B2 6/2015 Ohta et al.
9,145,284 B2 9/2015 Finkbeiner et al.
9,254,990 B2 2/2016 Matthews et al.
2003/0075657 A1 4/2003 Joubert
2004/0200258 A1 10/2004 Hess
2004/0262490 A1 12/2004 King
2009/0249714 A1* 10/2009 Combs ..... E04B 1/34 52/190
2010/0243973 A1 9/2010 Deuring et al.
2011/0309316 A1 12/2011 Kim

FOREIGN PATENT DOCUMENTS

DE 433136 C 8/1926
DE 2008788 A1 10/1971
DE 2231488 A1 1/1974
DE 3340883 A1 5/1985
DE 9115317 U1 3/1992
EP 0615645 A1 9/1994
FR 1109336 A 1/1956
GB 783915 A 10/1957
GB 2084541 A 4/1982
IT VR 930014 U1 10/1994
JP H03166199 A 7/1991
JP H08333093 A 12/1996
JP 2004352458 A * 12/2004
WO WO 93/11517 A1 6/1993

(56) References Cited

FOREIGN PATENT DOCUMENTS

WO WO 1995/011189 A1 4/1995
WO WO 2007/148960 A1 12/2007

OTHER PUBLICATIONS

Chief Automotive Systems Streamliner Productivity brochure (1999), 2 pgs.
Dymax x-100 (brochure), 3 pgs.
Iyasaka System Car-O-Liner Mini Bench brochure (1997), 8 pgs.
RosAuto Mini Tir Straightening Bench brochure, 3 pgs.
Spanesi Iberica, S.L. Mini Bench brochure (Automechanika 1996), 5 pgs.
U.S. Office Action dated Aug. 5, 2003 for U.S. Appl. No. 10/055,800, 10 pgs.
U.S. Notice of Allowance dated Mar. 19, 2004 for U.S. Appl. No. 10/055,800, 4 pgs.
U.S. Notice of Allowance dated Mar. 30, 2005 for U.S. Appl. No. 10/055,800, 4 pgs.
Before the Patent Trial and Appeal board, *Mohawk Resources Ltd.*, Petitioner, v. *Vehicle Service Group, LLC*, Patent Owner, Case IPR2014-00464, U.S. Pat. No. 6,983,196 B2, Decision, Institution of Inter Partes Review, Aug. 29, 2014, 20 pgs.
Before the Patent Trial and Appeal Board, *Mohawk Resources Ltd*,. Petitioner, v. *Vehicle Service Group, LLC*, Patent Owner, Case IPR2014-00464, U.S. Pat. No. 6,983,196 B2, Judgment, Termination of the Proceeding, Sep. 12, 2014, 3 pgs.
U.S. Office Action dated Apr. 7, 2015 for U.S. Appl. No. 13/290,270, 6 pgs.
U.S. Notice of Allowance dated Nov. 10, 2015 for U.S. Appl. No. 13/290,270, 5 pgs.
International Search Report and Written Opinion dated Jun. 28, 2010 for Application No. PCT/US2010/032647, 7 pgs.

* cited by examiner

PRECAST CONCRETE PIT

REFERENCE TO RELATED APPLICATION

This application claims priority to and is a non-provisional of U.S. Provisional Patent Application No. 62/199,740, filed Jul. 31, 2015, with title "Precast Concrete Pit."

BACKGROUND

A vehicle lift is a device operable to lift a vehicle such as a car, truck, bus, etc. Some vehicle lifts operate by positioning two runways at, or near, a shop floor level. The vehicle may be then driven or rolled onto the runways, allowing the runways to support the vehicle. The underside of each runway may be attached to a plurality of powered or manually actuated lifting assemblies. The lifting assemblies may be actuated to raise the runways and the vehicle to a desired height. Afterward, the vehicle may then be lowered once the user has completed his or her task requiring the vehicle lift. In some cases, the lifting assemblies may comprise a single elongated member which may rotate relative to the floor to pivot the runways upwardly. Because of the rotational motion of the lifting assemblies, some horizontal motion of the runways may be encountered. In other cases, the lifting assemblies may comprise a plurality of linkages which pivot relative to one another to cause the runways to rise upwardly, similar to a pair of scissors.

Examples of vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,601,430, entitled "Jack with Elevatable Platform," issued Aug. 5, 2003, the disclosure of which is incorporated by reference herein; U.S. Pat. No. 6,484,554, entitled "Portable Lift and Straightening Platform," issued Nov. 26, 2002, the disclosure of which is incorporated by reference herein; U.S. Pat. No. 6,269,676, entitled "Portable Lift and Straightening Platform," issued Aug. 7, 2001, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 5,199,686, entitled "Non-Continuous Base Ground Level Automotive Lift System," issued Apr. 6, 1993, the disclosure of which is incorporated by reference herein; U.S. Pat. No. 5,190,122, entitled "Safety Interlock System," issued Mar. 2, 1993, the disclosure of which is incorporated by reference herein; U.S. Pat. No. 5,096,159, entitled "Automotive Lift System," issued Mar. 17, 1992, the disclosure of which is incorporated by reference herein; and U.S. Pub. No. 2012/0048653, entitled "Multi-Link Automotive Alignment Lift," published Mar. 1, 2012, the disclosure of which is incorporated by reference herein.

Vehicle lifts require substantial structural and/or mechanical support for the lift device itself and the weight of the vehicle being lifted. Some lift systems have that support above ground, while others have it below ground. With in-ground systems, a pit is typically constructed to contain the support.

In some in-ground systems, the lift support frame assemblies are attached to freshly poured concrete pit wall sections that can take multiple concrete pours to construct. Some require extensive framing for the concrete walls, and they may involve assembling block walls and filling voids with concrete. With all of these methods, the ground in which the pit is constructed is typically dug out substantially wider than the concrete structure so that personnel can safely position themselves in the trench to build the structure. The extra space must then be backfilled, and both the additional removal of earth and the backfilling process can weaken the area around the pit.

While a variety of concrete pits have been made and used, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawing, in which like reference numerals identify the same elements and in which.

Figure 1:
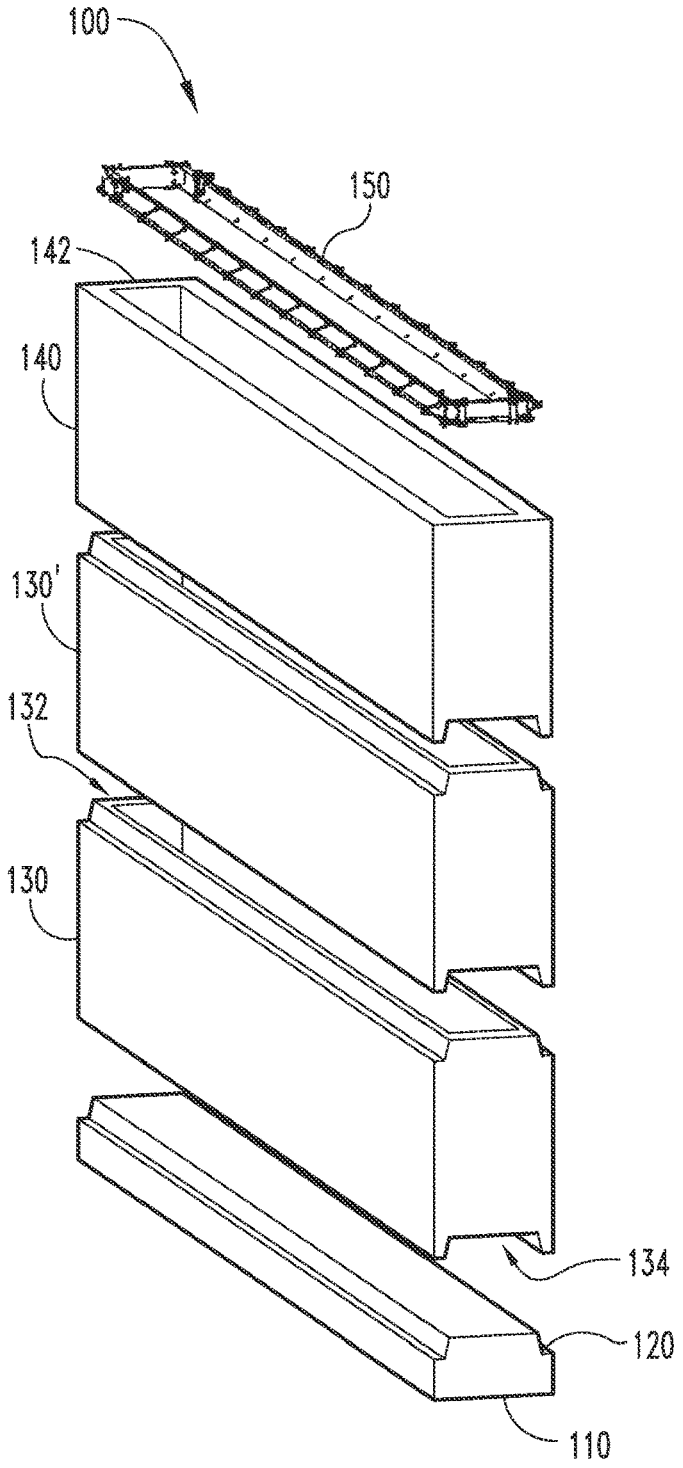
FIG. 1 is an exploded, perspective view of a precast concrete lift pit according to a first embodiment.

The drawings are not intended to be limiting in any way, and it is contemplated that various embodiments of the invention may be carried out in a variety of other ways, including those not necessarily depicted in the drawings. The accompanying drawings, incorporated in and forming a part of the specification, illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects and implementations, all without departing from the invention. Accordingly, the drawing and description should be regarded as illustrative and not restrictive in nature.

In the illustrated embodiments, an in-ground jack frame assembly is placed atop precast cured concrete pit sections. The benefits of this approach include that there is no need to put a person in the trench, so the required excavation, slab cutting, benching, etc. is substantially reduced, yielding a great deal of cost and time savings. Various implementations of the systems and methods described herein reduce construction waste, minimize site disturbance by the installation, and are better adapted for LEED buildings.

FIG. 1 shows a sample implementation of a precast concrete pit according to the present disclosure. Considering pit structure 100, a site is prepared by excavating ground sufficient to contain the pit or vault needed for the lift base and support structures. Precast slab 110, which will form the base of pit structure 100, has a top surface that slopes toward the center, where in some embodiments a small sump pit is cut out and/or a knock-out is created for one or more floor drains. A groove 120 around the outer edges of slab 110 facilitates self-centering and sealing of the walls with the slab along those corners.

Precast wall piece 130 is a box with an open top 132 and open bottom 134. The top and bottom edges of wall piece 130 have complementary components with the edges of precast slab 110 and the wall piece 130' that will sit on top of it to form suitable interfaces, preferably waterproof, tongue-and-groove connections. The height of each wall piece 130, 130', and upper precast wall piece 140 is selected so that the top of upper precast wall piece 140 reaches floor level, which might be any height above precast slab 110 and might be reached by combination of any number of (one or more) precast wall pieces 130, 130', 140. In the illustrated embodiment, upper precast wall piece 140 has top edge 142 that is preferably adapted to interface with jack frame 150 as will occur to those skilled in the art.

When pit structure 100 is installed, the site is prepared by excavating a trench sufficient to contain the pit structure 100 with a modest margin to allow for placement. In some embodiments, the trench will be approximately 4 feet wide and 34 feet long. Of course, soil content, ground conditions, water table, and other factors may require different excavation techniques, sizes, and processes as will occur to those skilled in the art in view of this disclosure. The base of the trench is preferably tamped, such as with the bucket of the excavator, so that the base is adequately compacted.

Figure 2:
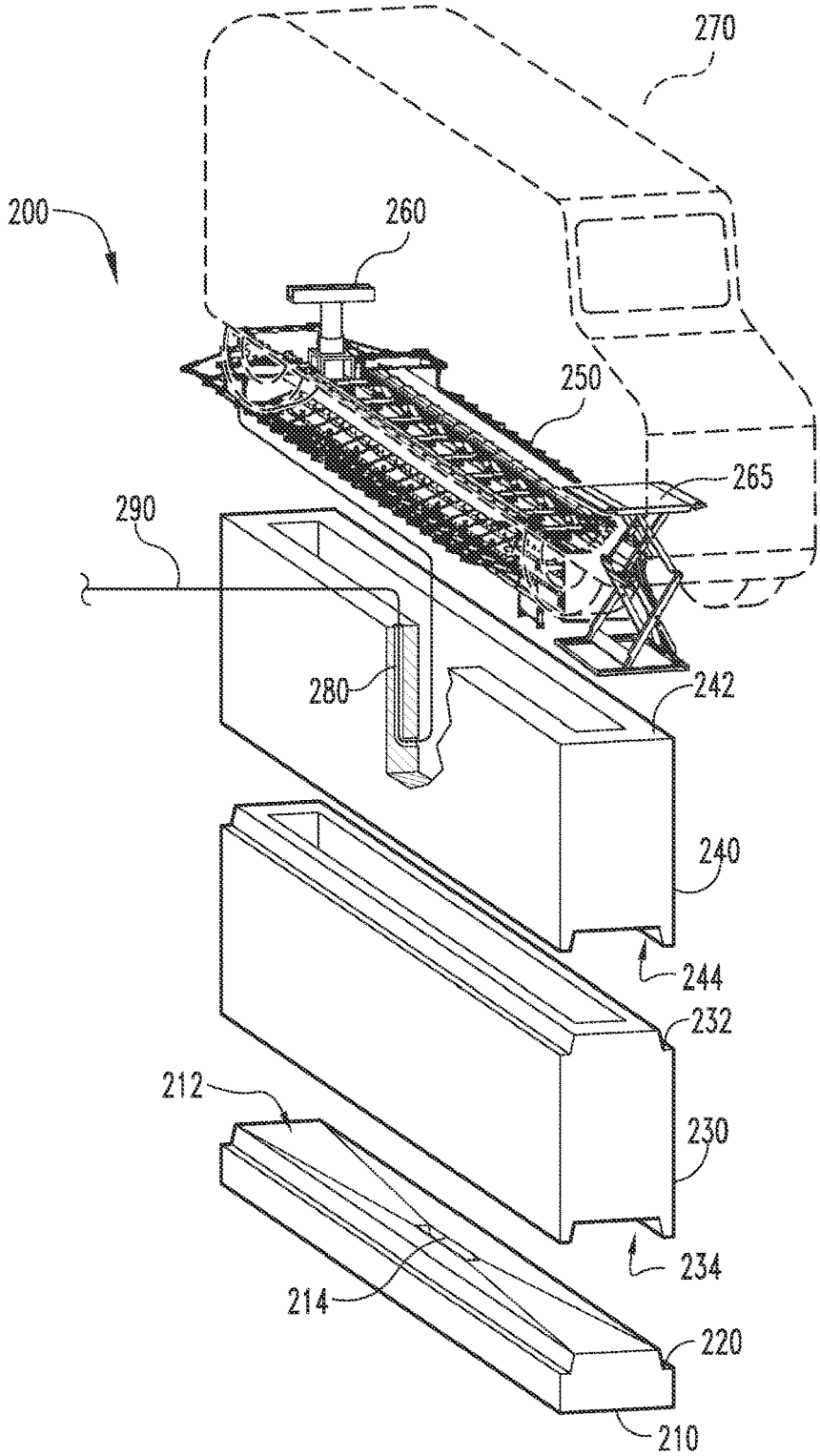
FIG. 2 is an exploded, perspective view of a precast concrete lift pit according to a second embodiment.

A layer of pea gravel, such as an 8-12" layer, is spread at the bottom of the trench, and self-leveling "lean" concrete is poured to create a level surface on which to place precast slab 110. When the lean concrete is sufficiently cured, precast slab 110 is lifted and placed into position by crane, hoist, or other means as will occur to those skilled in the art. Likewise, wall pieces 130, 130', 140 are sequentially placed on precast slab 110 until the desired height of pit structure 100 is reached. Crushed stone or other material is placed between the walls and the surrounding earth to backfill the slack space. A slab floor of the surrounding structure is then formed and placed. A lift is installed, including placing a jack frame in a position fixed relative to the precast vault assembly, and associating an actuation member 260 (see FIG. 2) with the jack frame so that the actuation member 260 is configured to lift a vehicle 270 from a lowered position to a raised position.

In some embodiments, the jack frame is attached to the top portion of the precast vault assembly, and in some embodiments, the jack frame is attached to the upper precast wall piece 140. An actuation member 260 appropriate for the lift being installed is associated with the jack frame and configured to lift a vehicle 270. In some embodiments, one or more wall pieces 130, 130', 140 are plumbed internally (see 280) to allow for routing of electronic, hydraulic, water, or other service connections 290 as desired. In some embodiments, at least one precast wall has an open top and an open bottom such that the at least one precast wall defines a hollow interior, and the vehicle actuation assembly is at least partially housed within the hollow interior as will occur to those skilled in the art in view of this disclosure. In some embodiments, a precast wall includes an internal plumbing conduit 280 that enables routing of one or more service connections 290 to the jack. In others, the precast floor has a top surface 212 that slopes toward its center where in some embodiments floor drains 214 are installed.

Alternative pit structure 200 is built on precast base 210 with connection features (such as grooves) 220 on or around its top surface. Precast wall piece 230 has mating features 234 along its bottom edge to facilitate connection with precast base 210, and further has features 232 along its top edge to facilitate connection with upper precast wall piece 240. Upper precast wall piece 240 has top edge 242 to connect with one or more components of the lift system and/or the floor of the surrounding building, represented in the figure by mechanical assembly 250.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should also be understood that the teachings herein may be readily applied to various kinds of lifts. By way of example only, the teachings herein may be readily applied to platform lifts, material lifts, man lifts, etc. The teachings herein may also be readily applied to robotic leg assemblies, adjustable work stations, and shock absorber systems. Various suitable ways in which the teachings herein may be incorporated into such systems and assemblies will be apparent to those of ordinary skill in the art. Similarly, various other kinds of systems and assemblies in which the teachings herein may be incorporated will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A vehicle lift assembly at least partially installed below ground, wherein the vehicle lift assembly comprises:

(i) a precast vault assembly configured to be placed at least partially into a trench, wherein the precast vault assembly comprises:

(a) a precast slab configured to be placed within a bottom portion of the trench, wherein the precast slab comprises a floor surface, and (b) at least one precast wall associated with the precast slab such that the at least one precast wall extends above the precast slab, wherein at least a portion of one of the at least one precast wall extends below the floor surface of the precast slab, wherein the at least one precast wall defines an open top and an open bottom such that the at least one precast wall defines a hollow interior, and wherein the at least one precast wall defines an internal plumbing conduit; and (ii) a vehicle actuation assembly, wherein the vehicle actuation assembly is at least partially housed within the hollow interior, wherein the internal plumbing conduit is configured for routing one or more service connections to the vehicle actuation assembly housed within the hollow interior, and wherein the vehicle actuation assembly comprises:

(a) a jack frame configured to be fixed relative to the precast vault assembly, and (b) an actuation member associated with the jack frame, wherein the actuation member is configured to lift a vehicle from a lowered position to a raised position.

2. The vehicle lift assembly of claim 1, wherein the precast slab and the at least one precast wall are separate from each other such that the precast slab may be placed within the trench separately from the at least one precast wall.

3. The vehicle lift assembly of claim 2, wherein the precast slab comprises a first mating feature, the at least one precast wall comprises a first precast wall that comprises a second mating feature, and is configured to be placed on top of the precast slab such that the first mating feature and the second mating feature interface with each other.

4. The vehicle lift assembly of claim 3, wherein the first mating feature and the second mating feature are a tongue-and-groove connection configured to facilitate self-centering of the precast slab and the first precast wall.

5. The vehicle lift assembly of claim 3, wherein the at least one precast wall further comprises a second precast wall, the first precast wall further comprises a third mating feature, the second precast wall comprises a fourth mating feature, and the second precast wall is configured to be placed on top of the first precast wall such that the third mating feature and the fourth mating feature interface with each other.

6. The vehicle lift assembly of claim 1, wherein the at least one precast wall comprises a top portion, wherein the jack frame is fixed to the top portion.

7. The vehicle lift assembly of claim 1, wherein the precast slab comprises a top surface that slopes toward a center of the precast slab.

8. The vehicle lift assembly of claim 7, wherein the precast slab defines one or more floor drains.

9. A vehicle lift assembly at least partially installed below ground, wherein the vehicle lift assembly comprises:

(i) a precast vault assembly configured to be placed at least partially into a trench, wherein the precast vault assembly comprises:

(a) a precast slab configured to be placed within a bottom portion of the trench, wherein the precast slab comprises a first mating feature, and (b) a first precast wall defining a first open bottom end and a first open top end, wherein (i) the first precast wall comprises a second mating feature associated with the first open bottom end, (ii) the second mating feature is configured to interface with the first mating feature of the precast slab, and (iii) the first precast wall extends above the precast slab toward an opening of the trench; and (ii) a mechanical assembly extending from a top portion of the precast vault assembly, wherein the mechanical assembly is at least partially fixed to the precast vault assembly, wherein the mechanical assembly is configured to raise a vehicle from a lowered position to a raised position such that the precast vault assembly structurally supports the mechanical assembly and the raised vehicle.

10. The vehicle lift assembly of claim 9, wherein:

the first precast wall further comprises a third mating feature associated with the first open top end, the precast vault further comprises a second precast wall defining a second open bottom end and a second open top end, the second precast vault comprises a fourth mating feature associated with the second open bottom end of the second precast wall, the third mating feature is configured to interface with the fourth mating feature such that the second precast wall is stacked on top of the first precast wall.

11. The vehicle lift assembly of claim 10, wherein the precast vault assembly defines internal plumbing configured for routing a service connection to the mechanical assembly.

12. The vehicle lift assembly of claim 10, wherein the first mating feature and the second mating feature are tongue-and-groove connections.

13. The vehicle lift assembly of claim 10, wherein the third mating feature and the fourth mating feature are tongue-and groove connections.

14. The vehicle lift assembly of claim 9, further comprising an upper precast wall comprising a top edge configured to mate with the mechanical assembly.

15. A vehicle lift assembly at least partially installed below ground, wherein the vehicle lift assembly comprises:

(i) a precast vault assembly configured to be placed at least partially into a trench, wherein the precast vault assembly comprises:

(a) a precast slab configured to be placed within a bottom portion of the trench, wherein the precast slab comprises a floor surface sloped toward a center of the precast slab, and (b) at least one precast wall associated with the precast slab such that the at least one precast wall extends above the precast slab, wherein at least a portion of one of the at least one precast wall extends below the floor surface of the precast slab; and (ii) a vehicle actuation assembly comprising:

(a) a jack frame configured to be fixed relative to the precast vault assembly, and (b) an actuation member associated with the jack frame, wherein the actuation member is configured to lift a vehicle from a lowered position to a raised position.

* * * * *